United States Patent [19]

Koltun

[11] Patent Number: 4,496,054

[45] Date of Patent: Jan. 29, 1985

[54] CORNER PROTECTOR FOR CONTAINERIZED ARTICLE

[75] Inventor: Harry M. Koltun, Palos Verdes Estates, Calif.

[73] Assignee: Arrow Container & Packaging Corp., Pico Rivera, Calif.

[21] Appl. No.: 601,724

[22] Filed: Apr. 18, 1984

[51] Int. Cl.[3] ..... B65D 81/02; B65D 85/30

[52] U.S. Cl. ..... 206/586; 206/453; 206/521; 206/523

[58] Field of Search ..... 206/586, 433, 453, 521, 206/523

[56] References Cited

U.S. PATENT DOCUMENTS

| | | | |
|---|---|---|---|
| 2,560,249 | 7/1951 | Risch | 206/586 |
| 3,283,988 | 11/1966 | Hardigg | 206/586 |
| 3,655,113 | 4/1972 | Carroll | 206/586 |
| 3,701,465 | 10/1972 | Richter | 206/586 |
| 3,836,043 | 9/1974 | Levin | 206/586 |
| 3,955,677 | 5/1976 | Collingwood . | |
| 3,973,720 | 8/1976 | Schmid . | |
| 4,287,265 | 9/1981 | McKnight | 206/586 |

FOREIGN PATENT DOCUMENTS

| | | | |
|---|---|---|---|
| 47801 | 6/1978 | Japan | 206/586 |
| 384223 | 5/1973 | U.S.S.R. | 206/586 |

*Primary Examiner*—Joseph Man-Fu Moy

*Attorney, Agent, or Firm*—Fulwider, Patton, Riber, Lee & Utecht

[57] ABSTRACT

A corner protector is provided for insertion between a shipping container and a packaged article generally at points likely to be impacted during shipping and storage to prevent or reduce damage caused to the article. The protector includes an inexpensive and lightweight outer shell which provides adequate cushioning for the packaged article against many types of compressive loads, and an impact resistant inner plug which is more pliable and has higher structural integrity than the shell. In one form, the shell is preferably constructed of an expanded polystyrene material having an inner tapered aperture, and the plug is preferably constructed of a molded polyethylene copolymer. The plug seats within the aperture and cooperates with the shell to form a tetrahedrally shaped corner protector having the plug at the apex to absorb an impact directed toward the protected corner of the article if the container is dropped or mishandled.

6 Claims, 5 Drawing Figures

CORNER PROTECTOR FOR CONTAINERIZED ARTICLE

BACKGROUND OF THE INVENTION

This invention relates generally to the packaging of articles in shipping containers, and, more specifically, to a corner protector having an inexpensive cushioning shell which positions an impact resistant plug to absorb, without shattering, an impact to a protected corner of an article if a container is dropped or mishandled.

It is widely recognized by manufacturers of various commodities that great care must be taken in packaging and shipping articles of manufacture to avoid damage caused by rough handling. Care must be particularly taken when articles such as furniture are packaged and shipped because much of the value of such articles lies in their aesthetic quality and appearance. Typically, in an attempt to protect articles from damage during shipping and storage, they are placed in shipping containers and provided padding or cushioning inserts at critical impact points. With most types of furniture and similar articles, the corners or other protruding sections are most vulnerable and require the greatest protection.

Previously, several types of cushioning inserts have been provided which are placed between the packaged article and the shipping container to reduce damage during shipping and storage. One type of insert is a corrugated paper or papier mache/pulp corner protector which is intended to absorb the shock of an impact if the container is dropped on a protected corner. A problem with such corner protectors is that the paper or paper pulp insert material inherently tends to retain moisture. This moisture can damage the finish of many articles, such as furniture, if the finish is subjected to the moisture for an extended period of time. Additionally, the paper or paper pulp corner protectors are undesirably rough and abrasive, usually necessitating the insertion of a foam pad between the corner protectors and the containerized article, and because of this rough and abrasive property they also undesirably generate heat through friction. Finally, the protection provided by such corner protectors from impacts and other compressive forces, when compared with the price of such protectors, is less than ideal.

An alternative corner protector is constructed of an expanded polystyrene material which tends to be less expensive than the corrugated paper or paper pulp protectors. While expanded polystyrene corner protectors adequately protect containerized articles from many types of compressive forces, the protective characteristics of such corner protectors is insufficient in many circumstances. Specifically, expanded polystyrene corner protectors tend to crack or fracture when subjected to impacting forces, and once these protectors are so damaged the protection provided against subsequent impacts is drastically reduced.

In attempting to overcome this drawback of expanded polystyrene protectors while still taking advantage of their cost, weight and overall compression resistance features, such polystyrene protectors have been encased in cardboard. The tensile strength of the cardboard casing is utilized to hold the expanded polystyrene insert together after a first impact to minimize the loss in protection against subsequent impacts. While these cardboard encased polystyrene corner protectors do increase the protection afforded containerized articles, the cost of such protectors is necessarily increased over that of simple molded expanded polystyrene protectors, and some manufacturers and shippers view the extra protection provided as not worth the additional costs involved.

Accordingly, there has been a need for a corner protector for containerized articles which can adequately protect the articles from most types of compressive loads, and which can repeatedly absorb the shock of impact without a significant reduction in the protection provided. Also, the corner protector must be inexpensive, lightweight, and constructed of materials which are easily manufactured and safely handled by packaging personnel. The present invention fullfils these needs and provides other related advantages.

SUMMARY OF THE INVENTION

The present invention resides in a corner protector for insertion between a shipping container and a packaged article generally at points likely to be damaged if the container is handled roughly during shipping or storage. The corner protector comprises generally an inexpensive, lightweight shell which provides an adequate cushion for the packaged article against most compressive forces, and a cooperating pliable plug which can repeatedly absorb the shock of impacting forces upon the protector. The shell and plug are constructed to generally cover and surround a protruding point of the protected article, such as the corner of a desk or table, to protect that protruding point from damage which could occur if the shipping container is dropped or otherwise mishandled.

In one preferred form, a two-piece corner protector is provided which includes an impact absorbing plug positioned within an aperture of a supporting shell. Three trapezoidal walls are joined together and orthogonally oriented to form a truncated tetrahedral shell which can be fit over a corner of a box-like protected article. The shell aperture is situated generally near the apex of the corner protector to permit the plug to be positioned in a location most likely to be subjected to the shock of an impact directed toward the protected corner. The shell aperture can be shaped to provide a larger inner opening which reduces down to a smaller outer opening to allow the plug to be inserted through the aperture until it interfittingly mates with the shell and becomes securely positioned within the aperture.

The shell is formed of a lightweight, inexpensive cushioning material, such as expanded polystyrene, which can adequately protect the corner of the containerized article from most types of non-impact forces. In contrast, the plug insert, which is positioned by the shell at a point most likely to receive any impacting forces, is constructed of a more pliable material having higher structural integrity and better impact resistance than expanded polystyrene. The plug insert is typically chosen from a material having characteristics similar to a polyethylene copolymer material which can be molded to the desired shape. One current commercially available example of such a material is an expanded polyethylene marketed under the mark ARFOAM, a trademark of the Atlantic Richfield Company. Combining of the plug and shell of different materials results in minimizing the overall cost of the corner protector while simultaneously providing vastly superior protection for the containerized article.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
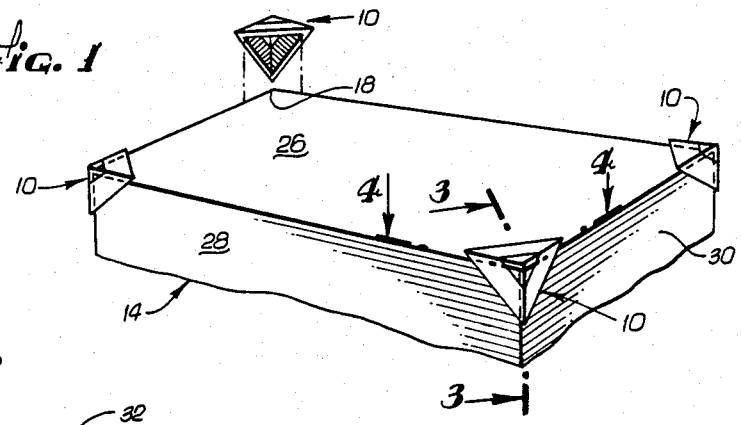
FIG. 1 is a fragmented, perspective view of a box-like article having three corner protectors positioned thereon and a fourth protector removed to illustrate the manner of emplacement.

As shown in the drawings for purposes of illustration, the present invention is concerned with a corner protector, generally designated by the reference number 10, comprising generally an inexpensive, lightweight shell 12 which provides an adequate cushion for a packaged article 14 against most compressive forces, and a cooperating pliable plug 16 which can repeatedly absorb the shock of impacting forces upon the protector 10. The corner protector 10 is inserted between a shipping container (not shown) and the packaged article 14 to generally cover and surround a protruding point or member of the article, such as the corner of a cabinet or the arm of a chair, to protect that protruding point or member and reduce or prevent damage to the article during shipping and storage if the container is dropped or otherwise mishandled.

In one form, the shell 12 and the plug 16 cooperate to form a corner protector 10 shaped like a hollow base tetrahedron which can be placed over a corner 18 of a box-like article 14. The plug 16 is positioned by the shell 12 at the outwardly extending apex of the corner protector 10 to absorb an impact if, for example, the shipping container is dropped on the protected corner 18, without degradation in the protection afforded the article 14 by the protector against further impacts. The plug 16 and shell 12 each are formed of different materials and combined in a manner emphasizing the most desirable qualities of each and minimizing any undesirable features. More specifically the shell 12 is preferably constructed of an easily molded material which insulates the article 14 from the container, does not damage the surface of most protected articles, and which can adequately cushion the article by itself in most circumstances. The plug 16 is preferably constructed of durable material having qualities similar to the shell material and which is more pliable and can repeatedly absorb impacts without fracturing or cracking.

The corner protector 10 of this invention advantageously combines at least two different components formed of different materials to emphasize the desirable properties of each to provide a protector having generally superior protective qualities at a better value. The avoidance of paper or paper pulp as a material used in the corner protector 10 reduces or eliminates problems commonly associated with such materials such as moisture retention, heat generation and abrasiveness. Also, the simplified manufacture and assembly of the component parts of the corner protector 10 reduces production costs and, ultimately, the price of the protectors to buyers. Moreover, the corner protector 10 can be manufactured in a variety of configurations and utilize several combinations of materials.

Figure 2:
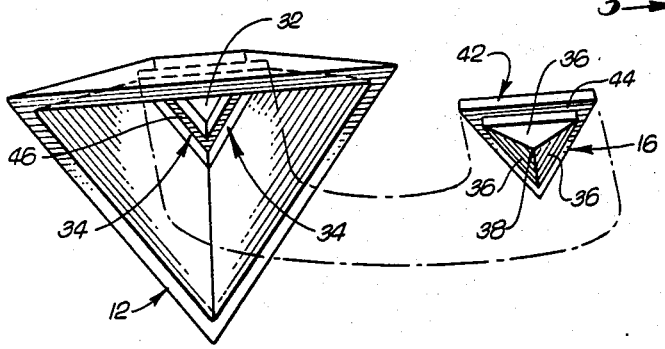
FIG. 2 is an exploded perspective view of a corner protector, illustrating the concave or inner side of a shell and the convex or outer side of a plug, and phantom lines showing generally the manner of inserting the plug into the shell prior to positioning the protector upon the protected article.

In accordance with the present invention, and as illustrated in FIGS. 1–5 in the accompanying drawings, the corner protector 10 includes a truncated shell 12 constructed by joining together three orthogonally oriented, trapezoidal walls 20, 22 and 24. When the shell 12 is positioned around the corner 18 of the box-like article 14, the corner generally extends through a hollow base of the shell and into a cavity formed by the interior surfaces of the walls so that a first wall 20 is positioned adjacent a top surface 26 of the article, a second wall 22 is positioned adjacent a front surface 28 of the article perpendicular to the top surface, and a third wall 24 is positioned adjacent a side surface 30 of the article perpendicular to both the top and front surfaces. The trapezoidal walls 20, 22 and 24 are shaped to provide, when joined, a central aperture 32 near the outwardly extending apex of the hollow base tetrahedron defining the corner protector 10, and the aperture forms a retaining sleeve 34 for the plug 16 when the shell 12 and plug are combined to form the corner protector 10 (FIG. 2).

The shell 12 is preferably formed of an inexpensive, lightweight material which is nonabrasive and provides some insulation between the shipping container and the article 14. The shell material should also be able to adequately cushion the article 14 and protect the covered portion of the article from damage due to ordinary handling while the container is being shipped and stored. Such properties are found in expanded polystyrene.

The plug 16 is generally sized and shaped to fit within the shell aperture 32, rest against and substantially cover the outermost point of the protected corner 18, and extend from the shell 12 to complete the tetrahedron. The plug 16 comprises an outer tetrahedral portion 36 whose surfaces and edges converge to a plug apex 38 which is positioned to most likely receive any impact forces directed to the protected corner 18, an inner surface 40 forming a tetrahedral cavity which cooperates with the interior wall surfaces to completely cover and surround the corner of the protected article 14, and sidewalls 42 which cooperate with the retaining sleeve 34 to securely hold the plug in place within the shell aperture 32. The plug 16 is chosen from pliable materials which have higher structural integrity and which better resist repeated impacts than the material of the outer shell 12, such as a polyethylene copolymer material which can be molded to the desired shape. Specifically, one current commercially available example of such materials is an expanded polyethylene sold by the Atlantic Richfield Company under the trademark ARFOAM. Another such commercially available material is marketed by the BASF Corporation under the name NEOPOLENE.

Figure 4:
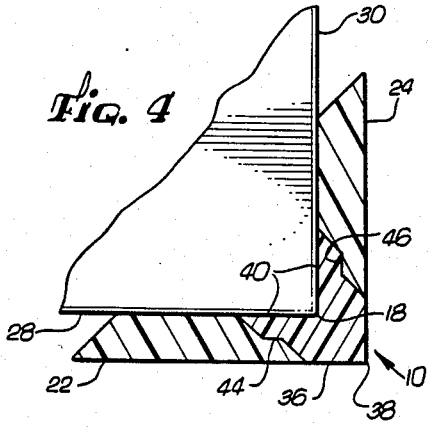
FIG. 4 is an enlarged, fragmented, horizontal section taken generally along the line 4—4 of FIG. 1.
Figure 3:
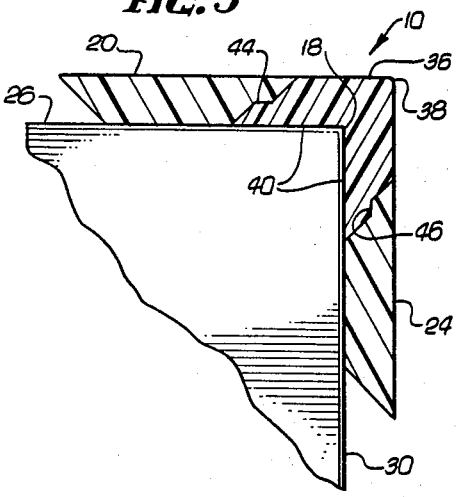
FIG. 3 is an enlarged, fragmented, vertical section taken generally along the line 3—3 of FIG. 1, illustrating the manner in which the corner protector generally overlies and protects a portion of the article.

To combine the shell 12 and plug 16 to form the assembled corner protector 10, the plug is inserted into the shell aperture 32 from the shell cavity until the retaining sleeve 34 fully engages the plug sidewalls 42, and the plug apex 38 is positioned at the outer apex of the tetrahedron. As illustrated in FIG. 2, the plug sidewalls 42 have a shoulder 44 which cooperates with a retaining neck 46 within the retaining sleeve 34 to prevent the outward travel of the plug 16 through the shell aperture 32 past its intended position by reducing the cross-section size of the sleeve in the direction toward the outer apex of the tetrahedron (FIGS. 3 and 4). The plug 16 can be bonded within the shell aperture 32 prior to placing the corner protector 10 on the article 14, or the plug can be placed loosely within the aperture and later moved into and held in the desired position when the corner protector is placed over a containerized article.

Figure 5:
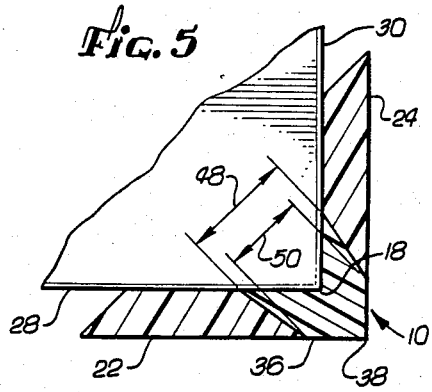
FIG. 5 is a fragmented sectional view similar to that shown in FIG. 4, illustrating an alternative interfitting relationship between the shell and plug.

As illustrated in FIG. 5, the size and configuration of the retaining sleeve 34 can be varied infinitely so long as the cooperating relationship between the retaining sleeve and the plug sidewalls 42 securely positions the plug 16 with respect to the shell 12. Specifically, in the alternate design shown, the retaining sleeve 34 is smoothly tapered from the cavity-side aperture where the average width of the aperture is indicated by the arrow 48, to the outer side of the aperture where the average width of the aperture is narrower as indicated by the arrow 50. Such a retaining sleeve 34 configuration allows the plug 16 to be slidingly inserted through the aperture 32 from the shell cavity, and retained in the predetermined and desired location to absorb impacts directed to the protected corner 18 of the article 14 just as effectively as the retaining sleeve configuration described in connection with FIGS. 3 and 4.

The corner protector 10 can be placed on the corners 18 of the article 14 either prior to packaging or after the article has been containerized. If emplaced prior to packaging, tape may be required to hold the protectors 10 in place while the article 14 was being packaged. After the article 14 has been properly placed within the shipping or storage container, tape is usually unnecessary because the corner protector 10 is preferably sized to contact the inner surface of the container as well as the outer surfaces 26, 28 and 30 of the article in a manner filling the intervening dead space. In the event the corner protector 10 doesn't fill this dead space, tape may still be required to hold the protector in place during shipping and storage of the containerized article 14.

From the foregoing it is to be appreciated that the corner protector 10 is capable of economically and reliable protecting the corners 18 of many types of articles 14 in a vastly superior manner than prior corner protectors. The combination of components formed of different materials to emphasize the strengths of the components and minimize their limitations maximizes the protection afforded the article 14. Moreover, the corner protector 16 avoids the undesirable properties inherent in paper, paper pulp and cardboard components found in other corner protectors.

Although a particular embodiment of the invention has been described in detail for purposes of illustration, various modifications may be made without departing from the spirit and scope of the invention. For example, the shell 12 could be formed without the central aperture 32, and the plug could be similarly configured to form a hollow base tetrahedron which either overlies or underlies the shell apex when the combination is joined together and placed upon the article 14. Such a design could advantageously and economically utilize the same mold to produce both the shell 12 and the plug 16. Accordingly, the invention is not to be limited, except as by the appended claims.

I claim:

1. A protector which substantially forms a hollow base tetrahedron for covering a corner of a box-like article, said protector comprising:

a hollow base shell having three walls joined to form a truncated portion of the tetrahedron, said shell including an aperture near an apex of the tetrahedron opposite the base, the portion of said shell forming said aperture also forming a retaining sleeve; and a plug which cooperates with said shell when inserted through said aperture to provide an apex section for the hollow base tetrahedron, said plug including sidewalls which cooperate with said retaining sleeve to hold and position said plug within said aperture, and a bottom surface forming a tetrahedral cavity in connection with an undersurface of said shell, said bottom surface and said undersurface covering a portion of three perpendicular surfaces of the article adjacent the protected corner.

2. A protector as recited in claim 1 wherein said shell is formed of a material which provides an adequate cushion for the article to protect it from damage in most circumstances.

3. A protector as recited in claim 2 wherein said shell is formed of an expanded polystyrene material.

4. A protector as recited in claim 2 wherein said plug is more pliable and has better impact resisting qualities than said shell.

5. A protector as recited in claim 4 wherein said plug is formed of a polyethylene copolymer material.

6. A protector as recited in claim 1 wherein said retaining sleeve includes a retaining neck which cooperates with a shoulder of said sidewalls to prevent the outward movement of said plug through said aperture when said protector is positioned on the article.

* * * * *